United States Patent [19]

Ryon

[11] 4,256,008

[45] Mar. 17, 1981

[54] MUSICAL INSTRUMENT TUNER WITH INCREMENTAL SCALE SHIFT

[75] Inventor: Donald C. Ryon, Carol Stream, Ill.

[73] Assignee: Motorola, Inc., Schaumburg, Ill.

[21] Appl. No.: 39,923

[22] Filed: May 17, 1979

[51] Int. Cl.[3] ..... G10G 7/02

[52] U.S. Cl. ..... 84/454; 84/DIG. 11; 84/DIG. 18; 324/78 R; 331/25

[58] Field of Search ..... 84/454, 1.01, 1.17, 84/DIG. 11, DIG. 18; 324/78 N, 78 Q, 78 Z, 79 R, 81, 88, 78 R; 331/18, 25

[56] References Cited

U.S. PATENT DOCUMENTS

| | | | |
|---|---|---|---|
| 2,958,250 | 11/1960 | Poehler | 84/454 |
| 3,876,936 | 4/1975 | Lester | 324/79 R |
| 3,939,751 | 2/1976 | Harasek | 84/1.17 |
| 4,078,469 | 3/1978 | Calvin | 324/79 R |

*Primary Examiner*—Donald A. Griffin
*Assistant Examiner*—S. D. Schreyer
*Attorney, Agent, or Firm*—Margaret Marsh Parker; James W. Gillman

[57] ABSTRACT

Instant scale shifting by predetermined increments is provided in a musical instrument tuning device by means of a programmable phase locked loop and crystal-controlled oscillator combination. The incremental scale steps are extremely accurate without need for recalibration and with no change in the tone intervals.

8 Claims, 5 Drawing Figures

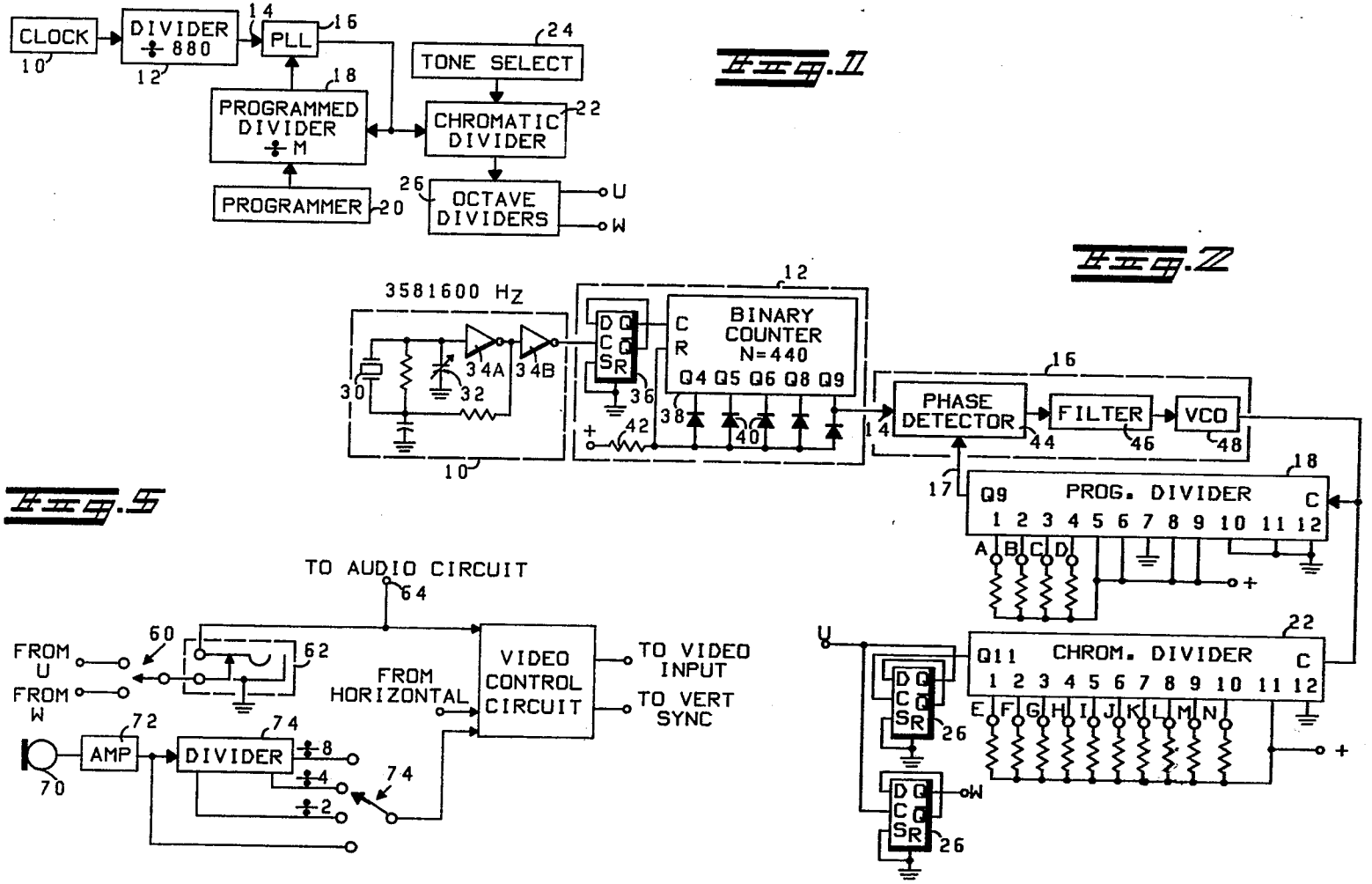
CLOCK
DIVIDER ÷ 880
PLL
TONE SELECT
CHROMATIC DIVIDER
OCTAVE DIVIDERS
PROGRAMMED DIVIDER ÷M
PROGRAMMER
3581600 Hz
BINARY COUNTER N=440
PHASE DETECTOR
FILTER
VCO
PROG. DIVIDER
CHROM. DIVIDER
TO VIDEO INPUT
TO VERT SYNC
VIDEO CONTROL CIRCUIT
TO AUDIO CIRCUIT
FROM HORIZONTAL
DIVIDER
AMP
FROM U
FROM W

MUSICAL INSTRUMENT TUNER WITH INCREMENTAL SCALE SHIFT

BACKGROUND OF THE INVENTION

This invention relates to the field of musical instruments and tuners therefor, and more particularly to a tuner having the capability of shifting an entire scale instantly by predetermined scale increments.

Programmable musical instruments such as those described in U.S. Pat. No. 3,821,460 and No. 3,939,751 have been programmed by manually resetting the appropriate switches in a bank of 120 switches per keyboard (manual or pedal). In U.S. Pat. No. 4,085,645, instant scale changing capability was added to such instruments by the use of DC programmable counters with DC switching. In another U.S. Pat. No. 3,876,936, a visual frequency comparator includes a CRT display device having a "split-screen". All of the patents listed above are assigned to the same assignee as is the present invention. Two audio frequencies can be compared on the screen by causing each signal to produce a horizontal bar pattern on a respective half of the screen. One set of bars is "synced" to provide a motionless reference pattern. If the other set of bars is also motionless the two frequencies being compared are either identical or have a relationship which is the ratio of two whole numbers; e.g., 3:2, 2:1. The respective numbers of bars denotes the frequency ratio, i.e., if three bars on the "unknown" side of the screen occupy the same space as two bars on the reference side, the ratio is 3:2 (the unknown frequency ratio is a perfect fifth above the reference). Relative motion indicates by direction the "sharp" or "flat" quality of the unknown frequency relative to the reference. The reference tone is normally internally generated but, if desired, another instrument can supply the reference.

A difficulty encountered with the above-described frequency comparator tuning device derives from the fact that different musicians and musical organizations vary in their choice of frequency for a given scale note. Most scales are based on the choice of frequency for the note designated "A" above middle "C".

The so-called "concert pitch" for this note is 440 Hz, but in actual use the pitch of the "A" may vary several hertz, depending generally on the conductor. It is therefore desirable to be able to tune "A" to any number (usually an integer) of hertz (cycles per second) within a range of 435 Hz to 446 Hz, and without manual reprogramming.

It is also desirable to shift the entire scale simultaneously without affecting the set intervals. The semitone interval in Equal Temperament, as in most music in the western world today, comprises a ratio of tones 1:1.06. For example, the frequency of "A#", the next note above "A", would be 1.06 times the frequency of A, regardless of the actual frequencies involved, 1.06 being the twelfth root of two and 2:1 being the ratio of an octave interval.

SUMMARY OF THE INVENTION

It is therefore an object of this invention to provide a device for accurately and easily comparing musical pitches and having the capability of shifting the entire scale up or down instantly by a predetermined increment.

This is accomplished in the circuit of the invention by a reference oscillator coupled through a phase locked loop to a programmable divider. The local oscillator in the PLL is designed to operate at a much higher frequency than the frequency to be compared, therefore the feedback loop of the PLL is coupled through the programmable divider and back to the phase comparator of the PLL. The PLL output is also coupled to a chromatic divider, controlled by a tone selector, and thence to octave dividers. The interval and exact pitch-controlled signals provide the reference frequency for the "synced" side of a split-screen frequency comparator.

BRIEF DESCRIPTION OF THE DRAWING

FIG. 1 is a partial block diagram of a partial circuit in accordance with the invention.

FIG. 2 is a schematic/logic/block diagram of the circuit of FIG. 1.

FIG. 3 is a schematic diagram of the programmer of FIG. 1.

FIG. 5 is a schematic/logic diagram of the interconnections of the circuit of FIG. 1 with the display device.

DETAILED DESCRIPTION OF A PREFERRED EMBODIMENT

Figure 4B:
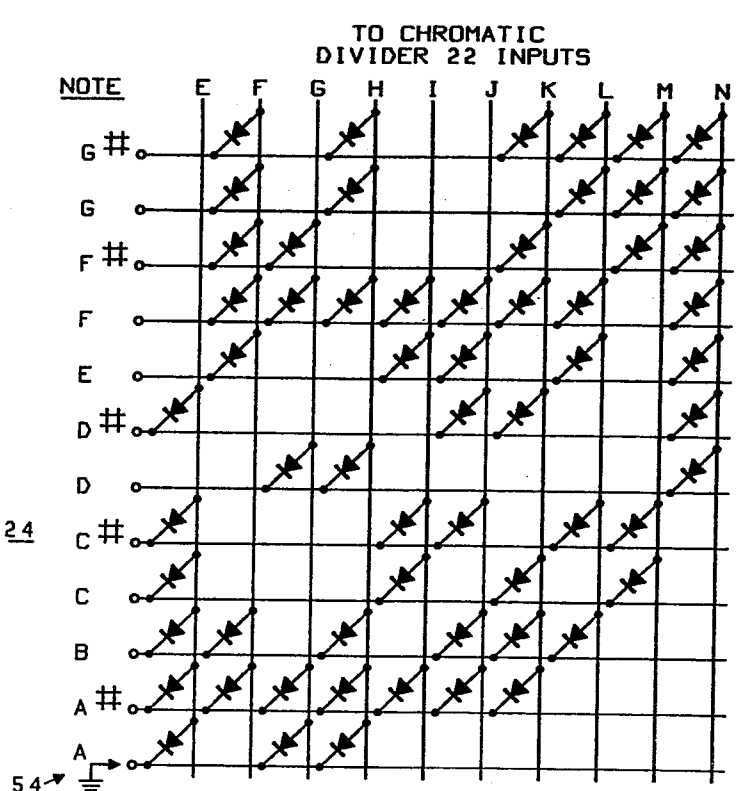
FIG. 4 is a schematic diagram of the tone select programmer which forms a part of the chromatic divider of FIG. 1.

FIG. 1 shows a block diagram form the circuitry to be coupled to the circuit of FIG. 5 in order to provide the improved display device of the invention.

As mentioned hereinabove, the original display device as claimed in U.S. Pat. No. 3,876,936 allowed for the determination of an unknown musical tone by means of a split-screen display including a bar generator. Bars on the left side of the screen represented a reference frequency and those on the right side the unknown frequency. While the reference frequency could be chosen to be any keyboard tone (A, A#, G, C, etc.) there was no provision in the patented device for changing "A" for example from the 440 Hz "standard" to 442 Hz.

In FIG. 1 a clock 10 will preferably be a crystal-controlled oscillator operating at a relatively high frequency, for example, 3,581,600 Hz. When this frequency is coupled through a divide-by-880 divider 12, the divider output signal is 4,070 Hz. This output signal is coupled to a first input 14 of a PLL 16. The feedback loop of the PLL 16 is coupled to a second input 17 through a programmed divider 18, controlled by programmer 20. The PLL output is also coupled to a chromatic divider 22. A tone select means 24 is coupled to the chromatic divider 22 for selecting the desired tone or note of the scale to be used as a reference tone on the display. One or more choices of octave may be provided by octave dividers 26. The use of octave dividers is, of course, optional and depends on the choices of clock frequency, dividers, and the range of reference tones required.

FIG. 2 provides a more detailed version of the diagram of FIG. 1. The clock 10 includes a relatively inexpensive crystal 30 with a fine adjustment capacitor 32, preferably having a range of 3–30 picofarads. One half of a quad NOR gate **34*a*, 34*b*** such as the Motorola MC14001 provides the buffer/output circuit as shown.

The clock frequency 3,581,600 Hz is divided by two in a flip-flop 36 which is preferably a Motorola MC14013 "D" type flip-flop. The Q output of the flip-flop 36 is coupled to the clock input of a counter 38 which is preferably a Motorola MC14040 binary counter. The counter 38 is programmed by five diodes 40 and a resistor 42 to divide the input frequency by 440, producing in this example an output of 4,070 Hz. In this type of binary counter, with no resetting, the output at Q9 would be the input frequency divided by 512 ($2^9$); that is, outputs Q1 to Q9 would be at a "high" or a logic one on every 512th count. With the diodes 40 coupling outputs Q4–Q9 to the reset pin of counter 38, the input frequency will be divided by 440. The 4,070 Hz output signal from Q9 is coupled to the input 14 of a phase detector 44 in PLL 16. The PLL also includes a filter 46 and a VCO 48, and functions much as does the usual PLL except that the VCO 48 is designed to operate at a frequency much higher than the 4,070 Hz input (near 1.79 MHz) and the VCO output is coupled back to the input 17 of the phase detector 44 through the programmed divider 18. It is known to use such a connection to provide a series of "synthesized" frequencies.

The programmed divider 18 may be comprised of three cascade-connected binary counters, the preferred choice being Motorola MC14516B up/down counters, connected to count "down" only. In this application, the counters are connected via points A-D to the programmer 20 (see FIG. 3) to allow division of the VCO 48 output by one of a set of predetermined numbers. As is known, dividing the output of the VCO of a PLL before feedback to the phase comparator causes the VCO output to be the input frequency multiplied by the divisor number. The divisor numbers are established by the programmer 20 interconnections, which effectively grounds selected ones of the first four data inputs of the divider 18 through a diode network 50. The predetermined divisor numbers are chosen to provide the desired set of integral frequency values for the "A" above middle "C" (435–446 Hz) and may be selected by means of a one-pole, twelve-position switch 52.

For example, if A equals 440 Hz is desired, the fourth "D" data input of the divider is grounded, the VCO output is divided by 440 (1,790,800) divided by 440 equals 4070) and the VCO output signal is locked on 1,790,800 Hz. When this is divided by 2,035 (in chromatic divider 22) the result is two times 440 or 880 Hz. If a value of only 435 Hz is desired for "A," the programmable divider 18 will be programmed, via divider 18 inputs A, C and D, to divide the VCO output by 435, forcing the VCO output to become 435 times 4,070 or 1,770,450 Hz. When this frequency is divided by 2,035 in chromatic divider 22, the result is 2 times 435 or 870 Hz.

The chromatic divider 22 may also be comprised of three cascaded IC's, preferably the Motorola MC14516B counters, as in the programmed divider 18. In this application, the appropriate divisor numbers for each scale tone are chosen by means of the tone selector 24 (see FIG. 4). The tone select function may be accomplished by a one-pole, twelve-position switch 54 and a network of diodes 56.

As mentioned hereinabove, if it is desired to have A equals 440 Hz as a reference, all other tones or notes of the scale will be an integral number of semitones removed from 440 Hz where the interval of a semitone is 1:1.06. When the diode network 56 is properly designed, all tones of the scale will be exactly tuned to the "A" chosen via switch 52 since the semitone intervals remain the same regardless of the actual frequencies of the tones.

As an example, if A equals 440 Hz, G will be two semitones lower or approximately 392 Hz (391.995436), or 440 divided by N divided N, wherein N is the twelfth root of 2. If A equals 435 Hz, G will be approximately 387.5 Hz or 435 divided by $N^2$.

In this application, the output frequency of the chromatic divider 22 is further divided by 2 and by 4 in the octave dividers 26, thus the output terminals U and W will provide the most used range of musical tones; i.e. the lowest value for "A" being 217.5 Hz and the highest value for G# being 842 Hz. The octave dividers 26 may be flip-flops such as the Motorola MC14013.

It should be noted here that all frequency values and interval ratios given herein are examplary only and are not to be construed as limiting the invention.

FIG. 3 is a diagram of the diode network 50 and switching circuit of the programmer 20. The switch 52 allows choice of the incremental (1.0 Hz) values for "A" and the appropriate diode interconnections provide the feedback loops in the programmed divider 18.

Figure 4A:
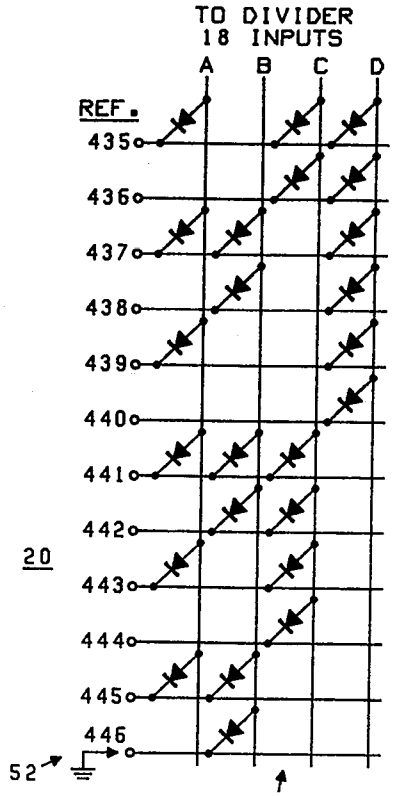

FIG. 4 is a drawing of the diode network and switching connections of the tone selector 24. In operation, the switch 52 would be utilized first to select the desired value for "A", then the various positions of the switch 54 would provide the corresponding frequency reference for each note of the scale.

FIG. 5 is a rudimentary diagram of the interconnections to the audio and video circuits of the visual display normally utilized in the invention. The octave divider output terminals U and W are coupled through a one-pole, two-position switch 60 and the phone jack 62 to an audio circuit input terminal 64 and to one input of a video control circuit 66. The phone jack 62 is included optionally in order to allow the use of the comparator with an external reference such as a piano or other musical instrument. The device is used in this manner for ear training.

The unknown or to-be-compared frequency may be picked up at a microphone 70, and amplified in an amplifier 72. The amplifier output is coupled to one terminal of a one-pole, four-position switch 74, and also to a divider 76 which divides the microphone input frequency by 2, 4 and 8, these divided outputs also being coupled to the switch 74, the switch output being coupled to the video control circuit 64.

Thus there has been shown and described a circuit arrangement for providing, in a musical pitch tuning device, instant scale shifting by predetermined and exact increments. The embodiment shown is given as an illustration only, to further the understanding of the invention, and is not to be construed as limiting the scope of the invention. It is intended to cover all such variations and modifications as fall within the spirit and scope of the appended claims.

What is claimed is:

1. Scale shifting circuitry for providing a plurality of frequencies having a predetermined frequency relationship and for shifting said plurality of frequencies by predetermined increments, and comprising in combination:

first oscillator means for providing a fixed frequency signal which is substantially higher than said plurality of frequencies;

a phase locked loop coupled to receive an output signal of the first oscillator means and including a second oscillator means adapted to provide an output signal at a frequency substantially higher than the output signal from the first oscillator means;

first programmed divider means coupled to receive the output signal from the second oscillator means of the phase locked loop, to divide said output signal by ones of a first plurality of numbers related to said predetermined incremental frequency shifts, and to couple the divided signal to the phase detector of the phase locked loop;

chromatically programmed divider means coupled to receive the output signal from the second oscillator means, and to divide said output signal by ones of a second plurality of numbers related to said plurality of frequencies; and output means coupled to the chromatically programmed divider means.

2. Scale shifting circuitry in accordance with claim 1 wherein the first oscillator means comprises a crystal oscillator and a fixed divider.

3. Scale shifting circuitry in accordance with claim 1 vider means comprises a med dibinary counter, a diode network, and increment selector means for coupling portions of the diode network to the binary counter.

4. Scale shifting circuitry in accordance with claim 1 wherein the chromatically programmed divider means comprises a second binary counter, a second diode network, and tone selector means for coupling portions of the second network to the second binary counter.

5. Scale shifting circuitry in accordance with claim 1 and further including at least one divide-by-two circuit coupled to the output of the chromatically programmed divider.

6. A tuning device for the visual comparison of two audio frequencies, having a video display screen and a bar pattern generator, and comprising in combination:

a video control circuit coupled to said screen;

first oscillator means for providing a reference frequency;

phase locked loop means coupled to the first oscillator means and including a second oscillator means adapted to provide a frequency substantially higher than the reference frequency;

first divider means coupled to the phase locked loop means for receiving the phase locked loop output frequency, dividing said frequency by ones of a first set of predetermined divisor numbers and coupling said divided frequency back to the phase comparator of the phase locked loop means;

second divider means coupled to the phase locked loop means for receiving the phase locked loop output frequency and dividing said output frequency by ones of a second set of predetermined divisor numbers, the output of the second divider means being coupled to the video control circuit for producing a fixed reference bar pattern on one portion of said video display screen;

input means for receiving an external signal and having an output coupled to the video control circuit for producing a second bar pattern on a second portion of the cathode ray tube screen.

7. A tuning device in accordance with claim 9 wherein the input means comprises a microphone and an audio amplifier coupled to the microphone output.

8. A tuning device in accordance with claim 7 wherein the input means further includes at least one divide-by-two circuit coupled to the amplifier output, and selector means coupled to enable selector means coupled to enable selection of ones of the amplifier output signal and the divide-by-two circuits.

* * * * *

UNITED STATES PATENT AND TRADEMARK OFFICE

CERTIFICATE OF CORRECTION

PATENT NO. : 4,256,008

DATED : March 17, 1981

INVENTOR(S) : Donald C. Ryon

It is certified that error appears in the above—identified patent and that said Letters Patent is hereby corrected as shown below:

Column 2, line 38, delete "G" and insert --B--.

Column 5, line 21, delete "vider means comprises a med dibinary" and insert --wherein the first programmed divider means comprises a binary--.

Column 6, line 26, delete "9" and insert --6--.

Signed and Sealed this

*Twenty-third* Day of *June 1981*

[SEAL]

*Attest:*

RENE D. TEGTMEYER

*Attesting Officer* *Acting Commissioner of Patents and Trademarks*